United States Patent [19]

Carmichael et al.

[11] 4,170,977

[45] Oct. 16, 1979

[54] IGNITION SYSTEM

[75] Inventors: Thomas F. Carmichael, Ortonville; Albert J. Dolecek, Lake Orion, both of Mich.

[73] Assignee: Syncro Corporation, Arab, Ala.

[21] Appl. No.: 752,301

[22] Filed: Dec. 20, 1976

[51] Int. Cl.[2] ..... F02P 1/00

[52] U.S. Cl. ..... 123/148 CC; 123/148 E

[58] Field of Search ..... 123/148 CC, 148 E, 149 B, 123/149 D, 149 C; 310/70 A, 183; 322/91; 315/209 CD, 209 SC, 206, 218

[56] References Cited

U.S. PATENT DOCUMENTS

| | | | |
|---|---|---|---|
| 3,405,347 | 10/1968 | Swift et al. | 322/91 |
| 3,484,677 | 12/1969 | Piteo | 123/148 CC |
| 3,629,632 | 12/1971 | Loupe | 310/153 |
| 3,667,441 | 6/1972 | Cavil | 123/148 E |
| 3,722,488 | 3/1973 | Swift et al. | 123/149 D |
| 4,019,485 | 4/1977 | Carlsson | 123/148 E |
| 4,036,201 | 7/1977 | Burson | 123/148 CC |

*Primary Examiner*—Charles T. Jordan

*Attorney, Agent, or Firm*—Harness, Dickey & Pierce

[57] ABSTRACT

A means for readily converting the ignition system of an existing internal combustion engine to a solid state capacitive discharge ignition system which comprises an auxiliary coil, a primary ignition coil and a secondary ignition coil wound on a single leg of a stator. The stator is designed with two additional mounting legs which adapt the stator for mounting on the existing structure of the engine and another leg adapted to cooperate with one of the mounting legs and the coil containing leg to complete a conductive path for a time varying magnetic flux.

12 Claims, 7 Drawing Figures

FIG. 1.
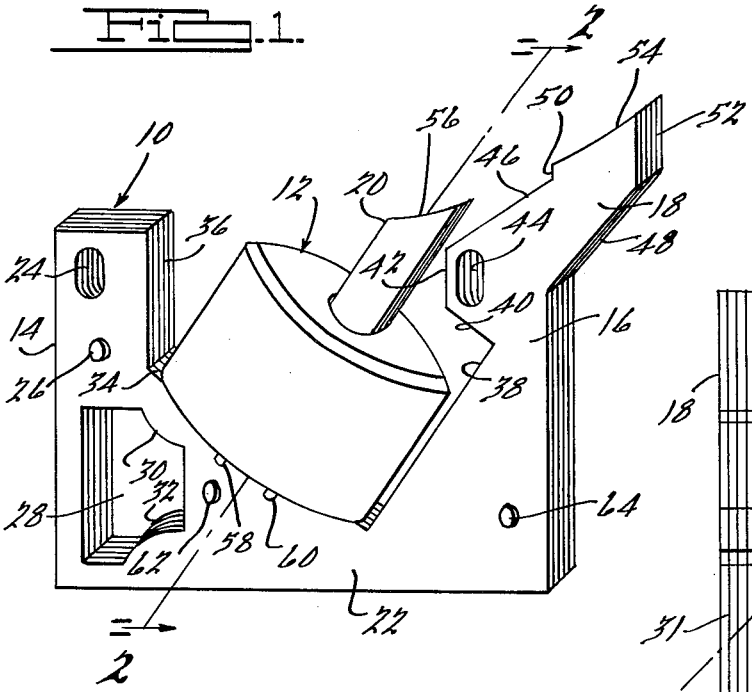
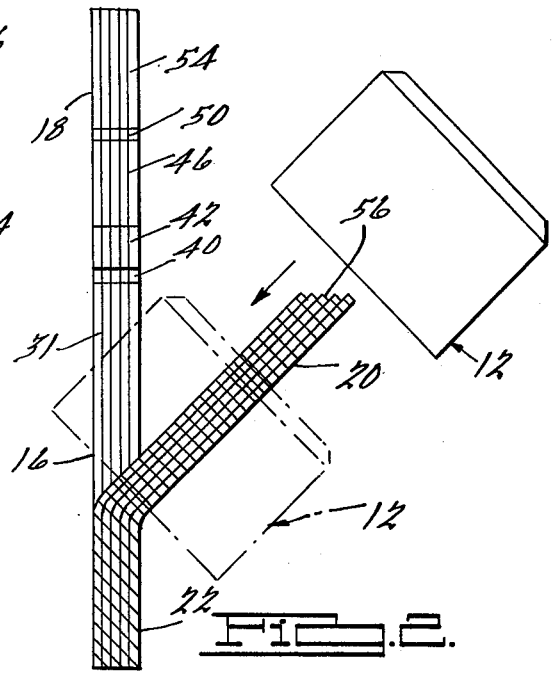
FIG. 2.
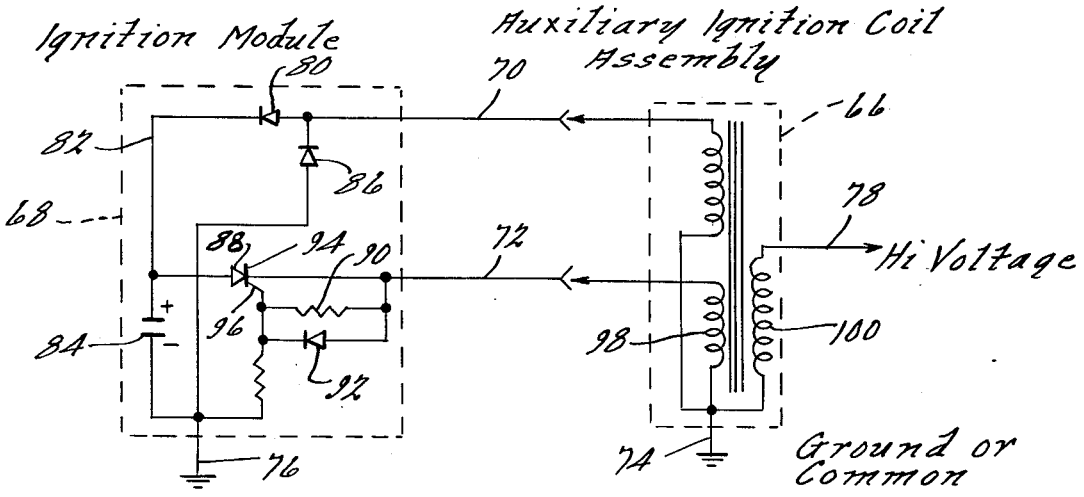
FIG. 3.

IGNITION SYSTEM

BACKGROUND AND SUMMARY OF THE INVENTION

This invention relates generally to ignition systems for internal combusion engines and in particular to means by which an existing internal combustion engine having a conventional ignition system may be provided with a capacitor discharge ignition system with minimal time and effort.

The capacitive discharge ignition system is generally of the type disclosed in the copending application of Thomas F. Carmichael for "Ignition System", Ser. No. 460,271, filed Apr. 12, 1974, now U.S. Pat. No. 4,056,088 and the copending application of Richard J. Maier and Thomas F. Carmichael for "Ignition System", Ser. No. 395,908, filed Sept. 10, 1973; now U.S. Pat. No. 3,941,111 both of which are assigned to the assignee of this application. Other means for converting a conventional internal combustion engine ignition system to a capacitive discharge system is disclosed in the copending application of Thomas F. Carmichael, Ser. No. 660,122, filed Feb. 23, 1976, assigned to the assignee of this application. The disclosure of each of these applications is incorporated herein by reference thereto.

Previously, the complex nature of capacitive discharge ignition systems made them prohibitively expensive for application to smaller internal combustion engines presently utilizing simple magneto ignition systems. With the development of the improved system disclosed in the first two above referenced copending applications, the number of components, package size, complexity and cost have been reduced sufficiently to allow the incorporation of such systems into these smaller sized engines such as are used in lawnmowers, chain saws, outboard motors, and the like. The ignition systems of the first two aforementioned applications are generally applicable for incorporation during original equipment manufacture of the associated engines whereas the invention of the last aforementioned application provides an inexpensive ignition replacement package whereby a wide variety of existing conventional magneto ignition systems may be easily converted to this improved capacitive discharge system by the owner of the engine subsequent to its initial purchase. However, in order to adapt certain conventional magneto ignition systems, it is necessary to provide a stator structure having provisions which allow it to be mounted on the existing mounting pads provided on the engine but yet provide a substantial shift in ignition timing so as to compensate for the differing response characteristics of a capacitive discharge system as opposed to a conventional magneto system. Also, as most small internal combustion engines have a sheet metal or plastic protective cover over the ignition system mounting area and may also have additional engine components or structure disposed nearby, severe space limitations often exist requiring specially designed stator structures in order to provide this ignition timing adjustment.

Accordingly, the present invention provides a stator structure and method of assembling a coil assembly thereto which is particularly designed to overcome these limitations as they exist in conventional Briggs and Straton five and eight horsepower engine configurations. Thus, the present invention provides means by which an owner of an implement powered by such an engine having a conventional magneto ignition system may avail himself of the advantages of a capacitive discharge ignition system at a relatively low cost, without any structural modifications to the engine itself, and without the need for any technical or specialized knowledge of ignition systems.

Additional advantages and features of the present invention will become apparent from the following detailed description taken in conjunction with the attached drawings and appended claims.

BRIEF DESCRIPTION OF THE DRAWINGS

FIG. 1 is a perspective view of a stator in accordance with the present invention having a coil assembly installed thereon;

FIG. 2 is a sectional view of the stator structure of FIG. 1 taken along line 2—2 thereof illustrating the method by which the coil is assembled thereto;

FIG. 3 is a schematic diagram of the capacitive discharge ignition system in accordance with the present invention;

DESCRIPTION OF THE PREFERRED EMBODIMENT

Figure 4:
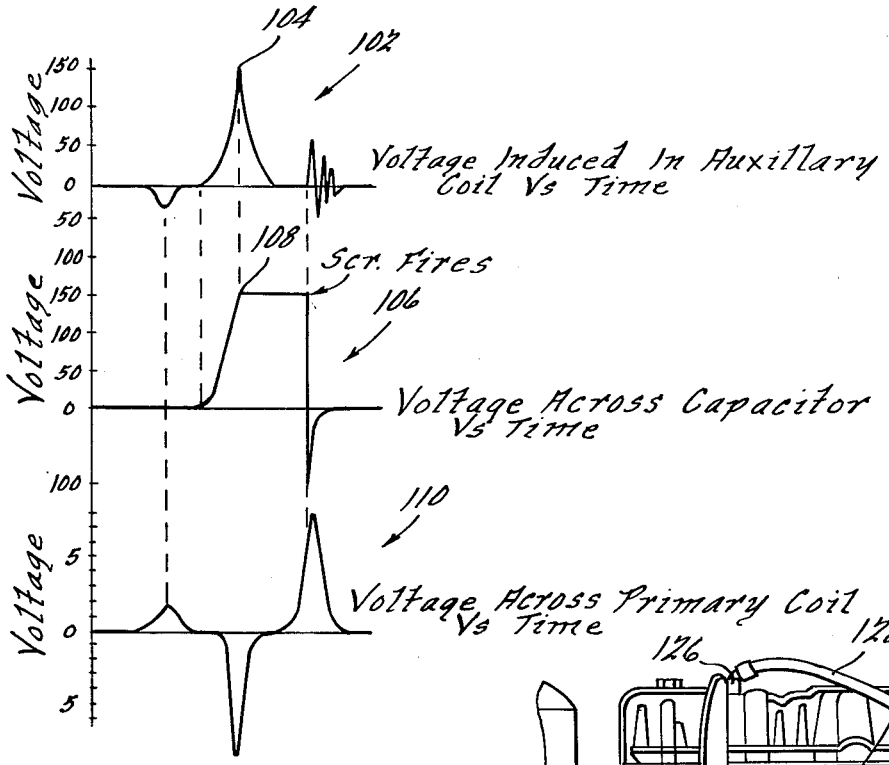
FIG. 4 is a graphical plot of voltage vs. time showing the operating waveforms for a capacitive discharge ignition system of the present invention.

Referring now to FIG. 1, a stator 10 is shown containing a coil assembly 12 on one leg thereof. Stator 10 has an irregular shape generally as shown and includes a first mounting leg member 14, a second mounting leg member 16, a first magnetic circuit leg member 18 extending outward from second mounting leg member 16, a second magnetic circuit leg member 20 and a main body portion 22 from which leg members 14, 16 and 20 extend.

Mounting leg member 14 extends generally perpendicularly outward from main body portion 22 and has a longitudinally elongated aperture 24 adjacent the terminal end portion thereof. A second smaller aperture 26 is disposed slightly inboard therefrom. A relatively large generally rectangular shaped aperture 28 is provided at the junction between mounting leg portion 14 and main body portion 22 and has two convex shaped corners 30 and 32 provided therein. Aperture 28 is provided to house the capacitive discharge ignition system module which contains the necessary electronic components as is described in greater detail below.

Main body portion 22 has an inner wall surface 34 extending from inner surface 36 of leg member 14 at an obtuse angle and terminates at a junction with wall surface 38 extending perpendicularly outward therefrom which also partially defines leg portion 16. Wall surface 38 terminates at its outer end at a relatively short surface 40 extending perpendicularly therefrom toward surface 36 which in turn terminates at surface 42 extending outward and parallel to surface 36. An elongated aperture 44 is provided in leg portion 16 which has a longitudinal axis parallel to aperture 24 on leg 14.

First magnetic circuit leg member 18 extends outward from leg member 16 and diagonally away from leg member 14 being defined by slightly converging opposite sidewall surfaces 46 and 48 each of which terminate at substantially parallel outwardly extending sidewall surfaces 50 and 52 respectively. End portion 54 of leg member 18 is adapted to be mounted in close proximity to a rotating flywheel carrying magnetic field generating means and has a concave shape with a radius of curvature substantially the same as or slightly greater than the diameter of this flywheel so as to provide a constant spacing therebetween along the entire surface of end portion 54. In the case of the Briggs and Straton eight horsepower engine this radius of curvature will be approximately 4.074 inches.

Second magnetic circuit leg portion 20 projects perpendicularly outward from surface 34 approximately midway between its terminal end portions and is generally rectangular in shape. Leg portion 20 also has an end portion 56 adapted to be mounted in close proximity to the rotating flywheel having a concave shape with a radius of curvature substantially the same as that of end portion 54. A pair of shallow slots 58 and 60 are provided on surface 34 adjacent opposite sides of the junction of leg member 20 with surface 34 which allows leg member 20 to be bent outward for installation of a coil assembly thereon as described in greater detail below without distortion of the laminations in the areas of these slots.

As is apparent from FIG. 1, both magnetic circuit legs 18 and 20 have longitudinal axis which form an acute included angle with a plane tangent to respective concave end portions 54 and 56 thereof so as to advance the ignition timing approximately 0.870 inches of flywheel circumference. This arrangement results in a substantially greater surface area of end portions 54 and 56 being placed in close proximity to the rotating magnetic field thereby promoting flux pickup therefrom without requiring any increase in the cross-sectional size of the respective magnetic circuit leg members 18 and 20 which would cause an increased inductance and result in high speed voltage fall off. Thus, these angled magnetic circuit leg members not only allow for proper adjustment of the ignition timing while enabling the stator structure to be secured to existing mounting provisions on the engine but also improve the operating efficiency of the stator structure as well.

Conventionally, the cores of magneto ignition systems are constructed of cold rolled steel. Cold rolled steel cores are used since the cold rolled steel is an excellent collector of flux emanating from the permanent magnets of the rotor. Although the core material of the ignition system disclosed herein can be cold rolled steel, it has been discovered that electrical steel, i.e., steel containing a silicon alloy as is used in transformer core constructions, provides a substantial increase in the output voltage of the ignition system. For example, output voltage increases of 40% has been obtained using electrical steel. It is believed that this substantial increase in output voltage is due to the fact that cold rolled steel is not a desirable core material for the ignition coil so that the voltage rise upon discharging of the capacitor into the primary winding of the ignition coil is hampered. The electrical steel is a more effective core for the ignition coil than cold rolled steel, and yet has a good capability of collecting the flux emanating from the permanent magnets of the rotor. The usual core materials for ignition coils are ferrite materials. These materials would not be satisfactory as a core material for the ignition system since they would not be good collectors of the flux emanating from the permanent magnets of the rotor. Accordingly, stator 10 is preferably constructed of multiple laminations of electrical steel which are secured by rivets or other suitable fastening means passing through aperture 26 and a pair of similar spaced apart apertures 62 and 64 provided on main body portion 22.

As is apparent from the illustration of FIG. 1, leg portions 16 and 18 prevent coil 12 from being installed on leg portion 20 by merely sliding it over the end portion thereof. While it may be possible to wind coil assembly 12 directly onto leg portion 20, this would be an expensive and time-consuming process. Accordingly, as best seen with reference to FIG. 2, in which stator structure 10 is illustrated in section taken along line 2—2 of FIG. 1, coil assembly 12 may be easily installed by first bending leg portion 20 outward from the plane defined by legs 14 and 16 a sufficient distance to allow coil assembly 12 to be slid over end portion 56 thereof without interference from leg portions 16 or 18. Once coil assembly 12 has been thus installed, leg portion 20 is then bent back into its original position so as to be coplanar with leg portions 14 and 16.

Stator 10 is thus designed to be mounted on existing mounting pads of an engine with convex surfaces 54 and 56 of legs 18 and 20 respectively, immediately adjacent the outer peripheral surface of a rotor of an existing conventional internal combustion engine. The rotor has a pair of magnets disposed on its outer peripheral surface which create a time varying magnetic flux in stator 10, as the magnets rotate past stator 10. Thus, legs 18, 16, and 20 and part of main body portion 22 define a conductive path for the flux created by this rotating magnetic field. As the flux is necessarily time varying with respect to stator 10, a voltage will thereby be generated in coil assembly 12.

Coil 12 is identical in construction to that disclosed in the copending application of Thomas F. Carmichael, Ser. No. 660,122, filed Feb. 23, 1976 and assigned to the assignee of the present application being comprised of a primary coil, a secondary coil wound over the primary coil and an auxillary coil located forward of the primary and secondary coils all of which are wound upon a form of a size suitable for installation on stator leg 20 as described above.

The completed coil assembly will preferably have an outer covering such as an epoxy compound or the like to seal it against moisture or other potentially damaging elements. Also, the coil will have provisions externally of this covering for the connection of the high voltage lead, a ground connection, and primary and auxilliary coil connection to the ignition module described below. Alternatively, the coil may be constructed with the ignition module integral thereto assuming space limitations permit. This will further simplify the conversion in that the only electrical connection required will be the high voltage lead.

As is apparent from FIG. 1, stator 10 is adapted to provide a substantial shift in ignition timing as the angular position at which the rotating magnetic field crosses legs 18 and 20 has been shifted approximately 0.870 inches by this unique stator structure. The existing mounting pads provided on the engine may still be used for securing the stator structure in position such as by bolts passing through elongated apertures 24 and 44. As apertures 24 and 44 are elongated, the air gap between end portions 54 and 56 and the rotating flywheel may also be easily adjusted.

Referring now to FIG. 3 the operation of the present invention will be described in detail. A coil assembly is shown schematically at 66 of FIG. 3. In operative position, the coil and appropriate stator structure described above would be securely mounted to the engine adjacent the rotor carrying the magnetic field generating means. An ignition module, as shown schematically at 68 of FIG. 3 is mounted on the engine in any convenient location and is electrically coupled to the coil assembly by conductors 70 and 72. Alternatively, as previously mentioned, this ignition module may be integral with the coil assembly should this be desirable. Both the coil assembly and ignition module have means 74 and 76 respectively, for creating an electrical connection to ground, which in this case may be the engine itself. Additionally, coil assembly 66 has a high voltage conductor 78 for conducting the ignition voltage to the spark plug.

As the rotating magnetic field, carried by the rotor, passes on close proximity to the stator core, it induces therein a time varying magnetic flux. As this flux increases in magnitude, it induces a voltage in the auxilliary coil with causes a current to flow from the coil assembly along conductor 70 through diode 80 and conductor 82 to capacitor 84 creating a positive charge thereon. Diode 86 is connected between conductor 70 and ground 76 and serves to dampen negative spikes induced in the auxilliary coil. The voltage induced in the auxiliary coil, as this time varying magnetic field increases in intensity, is plotted against time in graph 102 of FIG. 4 with maximum intensity being achieved at point 104. Graph 106 shows the voltage vs. time plot of the charging of capacitor 84 in response to the induced voltage on the auxiliary coil. As shown graphically, capacitor 84 achieves a maximum charge at point 108 which corresponds in time to the maximum rate of change of flux intensity passing through the stator coil. As diode 80 only conducts in one direction, the charge on capacitor 84 will be maintained.

A switch means 88 such as a silicon controlled rectifier (SCR), is provided between capacitor 84 and primary conductor 72 connected to the primary coil winding. A resistor 90 and a diode 92 are connected in parallel between the cathode 94 and gate 96 of SCR 88. Diode 92 serves to protect SCR 88 from positive transients induced in the primary coil winding during the charging of capacitor 84.

As the rotating magnetic field begins to move out of alignment with the stator, the magnetic flux following therethrough begins to drop. This then causes a negative voltage to be induced in the primary coil, thus causing a current to flow through conductor 72. This will then cause gate 96 of SCR 88 to be positively biased with respect to cathode 94 thus causing SCR 88 to become conductive. This is shown graphically in graph 110 of FIG. 4 which plots voltage vs. time as measured across the primary winding. When SCR 88 becomes conductive, capacitor 84 will discharge through SCR 88 and through primary coil 98. As the primary and secondary ignition coils are magnetically coupled, the discharge through primary coil 98 cooperatively with the time varying magnetic flux induces the ignition spark generating voltage in secondary coil 100.

In order to maintain maximum operating efficiency of the engine, it is important to insure capacitor 84 will repetitively fire at precisely the same time relative to the angular position of the crankshaft with as little variation as possible over the entire broad speed range of the engine. It has been found through experimentation that the ignition module circuit of FIG. 3 in cooperation with the degree of magnetic coupling of the ignition and auxiliary coils and their polar relationships plus the lack of frequency sensitivity in the SCR gate network produce greater timing stability than found in conventional ignition systems.

Figure 6:
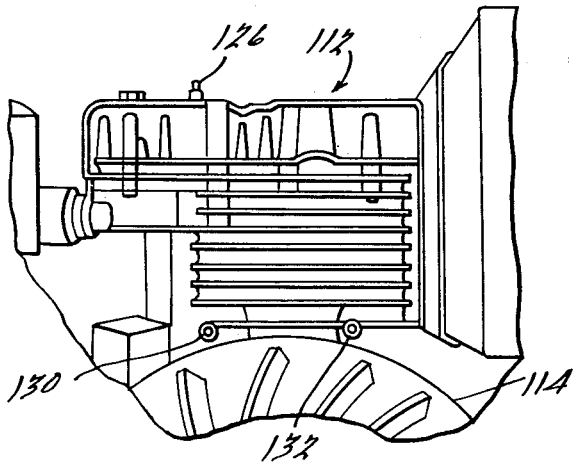
Figure 7:
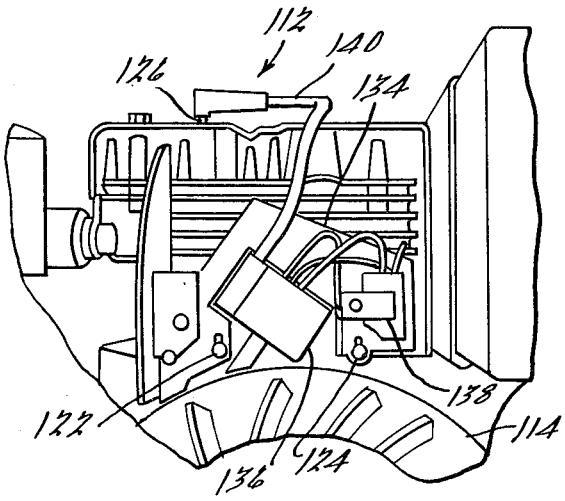

The sequence of operations necessary to convert a conventional ignition system of a Briggs and Straton 5 or 8 horsepower engine to the capacitive discharge ignition system of the present invention is illustrated and will be described in detail with reference to FIGS. 5 through 7.

Figure 5:
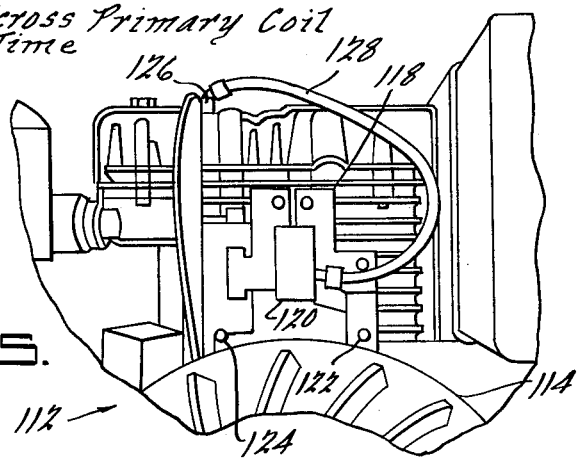
FIGS. 5–7 are views of a typical lawn tractor engine with the sheet metal cowling removed and showing in sequence the existing ignition system installed thereon, the engine with the conventional ignition system core and coil removed, and the engine with the ignition system of the present invention installed thereon.

FIG. 5 shows a Briggs and Straton 5 or 8 horsepower engine with the sheet metal cowling removed indicated generally at 112 and having a flywheel 114 carrying a magnetic field generating means secured in a fixed position to a crank shaft. A conventional ignition stator 118 and coil 120 is mounted on engine 112 adjacent flywheel 114 by threaded fasteners 122 and 124 in a position such that a high voltage ignition spark will be induced in coil 120 and transmitted to spark plug 126 by lead 128 at a predetermined position of flywheel 114.

In order to install the stator and coil assembly of the present invention, it is first necessary to remove threaded fasteners 122 and 124. Stator 118 and coil 120 may then be removed thereby exposing mounting pads 130 and 132 provided on the engine itself as is best seen in FIG. 6. A stator 134, having a coil assembly 136 and ignition module 138 secured thereto all in accordance with the present invention is then secured to mounting pads 130 and 132 by threaded fasteners 122 and 124. As best seen in FIG. 7, the unique design of stator 134 shifts the angular position at which the magnetic field generating means passes the flux conducting legs thereof thus automatically compensating for the difference in response characteristics of the capacitive discharge ignition system as opposed to the conventional ignition system. Thus, all that remains is to connect high voltage lead 140 to spark plug 126 and reassemble the engine cowling to complete the conversion as the ignition coil and module are preconnected and the engagement of the stator and engine provides a grounding connection.

There is thus disclosed herein means by which any individual having a very few basic tools may easily convert the existing ignition system of his lawnmower or the like to the capacitive discharge ignition system of the present invention. As is apparent from the above description there is provided means by which the difference in ignition timing of the capacitive discharge ignition system relative to the conventional ignition system may be compensated for so as to maintain the ignition timing of the engine. The absence of any necessity to perform delicate machining operations or the need for any complex engine modifications makes it possible to completely eliminate the need for any knowledge whatsoever of machinery operations or engine ignition systems theory by the owner. Further, as the replacement of parts is minimized, the individual may achieve the advantages inherent in a capacitive discharge ignition system at a relatively small investment of money and time.

It is to be understood that the foregoing description is that of a preferred embodiment of the invention. Various changes and modifications may be made by one skilled in the art without departing from the spirit and scope of the invention as defined by the appended claims.

We claim:

1. For an internal combustion engine having a magnetic field which rotates in a circular path about a predetermined axis and which has been adapted to operate with a conventional ignition system with first and second stator legs cooperative with said rotating magnetic field at first predetermined positions on said circular path for providing high voltage ignition pulses for said engine, said engine further having mounting means thereon for securing said conventional ignition system to said engine with said stator legs in said first predetermined positions relative to said rotating magnetic field to provide ignition timing for said engine, a substitute capacitive discharge ignition system comprising:

an ignition coil adapted to provide high voltage ignition pulses for said engine;

capacitive discharge circuit means including a capacitor adapted to be discharged into said ignition coil for providing high energy ignition pulses; and a stator structure carrying said ignition coil having a main body portion, at least one mounting leg extending outward from said main body portion, a first magnetic circuit leg having an end surface in close proximity with said circular path, and a second magnetic circuit leg having an end surface in close proximity with said circular path, said mounting leg cooperating to secure said stator to said mounting means, each of said first and second magnetic circuit legs being obliquely disposed in the same direction relative to a radial line of said circular path which intersects its respective end surface so that said respective end surfaces cooperate with said circular path at second predetermined positions on said circular path to substantially maintain said ignition timing for said engine, said second predetermined positions being displaced from said first predetermined positions in accordance with the difference of said ignition timing of said conventional ignition system and said capacitive discharge ignition system, whereby said first and second magnetic circuit legs cooperate with said rotating magnetic field and said capacitive discharge circuit means to produce said high energy ignition pulses at appropriate times for operation of said engine.

2. A substitute ignition system as set forth in claim 1 wherein said magnetic circuit legs are further adapted to cooperate with said ignition coil and said capacitive discharge circuit means to charge said capacitor.

3. A substitute ignition system as set forth in claim 2 wherein said magnetic circuit legs are further adapted to cooperate with said rotating magnetic field to cause said capacitor to discharge into said ignition coil.

4. A substitute capacitive discharge ignition system as set forth in claim 3 wherein said first and second magnetic circuit legs are of a length so that said end surfaces are spaced approximately the same distance from said circular path when said stator is secured to said mounting means.

5. A substitute capacitive discharge ignition system as set forth in claim 1 wherein said end surfaces of said first and second magnetic circuit legs are concave and form an acute inclined angle at a point of intersection between the arc of curvature within which said concave surfaces lie and the longitudinal axis of said first and second magnetic circuit legs.

6. A substitute capacitive discharge ignition system as set forth in claim 5 wherein the radius of curvature of said concave end surfaces is equal to the radius of said arc scribed by said rotating magnetic field.

7. A substitute capacitive discharge ignition system as set forth in claim 1 further including a pair of slots in said main body portion disposed immediately adjacent opposite sides of the junction between said second magnetic circuit leg and said main body portion.

8. A substitute ignition system as set forth in claim 1 wherein said first and second magnetic circuit legs are inclined so as to dispose each said second predetermined positions from the correlative first predetermined positions in the same direction.

9. A substitute ignition system as set forth in claim 1 wherein said first and second magentic circuit legs are disposed along respective axes and each of said end surfaces are obliquely disposed relative to the respective ones of said axes so that the area of the cross-section of each of said first and second magnetic circuit legs which is perpendicular to said respective axis is substantially less than the area of the respective end surface.

10. A method of constructing a replacement stator for use in converting a conventional ignition system having a rotating magnetic field adapted for generating high voltage ignition pulses to a capacitive discharge ignition system comprising the steps of:

fabricating a plurality of simiarly-shaped stator laminations having at least one mounting leg, a main body portion, a first magnetic circuit leg extending obliquely outward relative to said main body portion and a second magnetic circuit leg extending obliquely outward relative to said main body portion, said stator being adapted to carry a coil assembly on said second magnetic circuit leg, said first and second magnetic circuit legs being coplanar with said main body portion and being closely-spaced to accommodate said rotating magnetic field, said close spacing preventing the sliding of said coil assembly onto said second magnetic circuit leg while said legs are coplanar;

stacking said laminations and securing said laminations together;

displacing said second magnetic circuit leg from said coplanar relationship with said main body portion outward;

sliding said coil assembly onto said second magnetic circuit leg while said second magnetic circuit leg is displaced; and returning said second magnetic circuit leg to said coplanar position.

11. A method of constructing a replacement stator as set forth in claim 10 further comprising the step of forming a beveled concave end surface on each of said first and second magnetic circuit legs.

12. A method of constructing a replacement stator as set forth in claim 11 wherein the radius of curvature of said concave end surfaces is equal to the radius of the arc traversed by said rotating magnetic field.

* * * * *